United States Patent [19]

Tomosada

[11] Patent Number: 4,557,588

[45] Date of Patent: Dec. 10, 1985

[54] IMAGE FORMING APPARATUS HAVING A CLEANING MEMBER

[75] Inventor: Masahiro Tomosada, Kawasaki, Japan

[73] Assignee: Canon Kabushiki Kaisha, Tokyo, Japan

[21] Appl. No.: 494,524

[22] Filed: May 13, 1983

[30] Foreign Application Priority Data

May 21, 1982 [JP] Japan ..... 57-86326
May 25, 1982 [JP] Japan ..... 57-88704
May 26, 1982 [JP] Japan ..... 57-89228
May 26, 1982 [JP] Japan ..... 57-89229

[51] Int. Cl.[4] ..... G03G 21/00

[52] U.S. Cl. ..... 355/14 R; 355/15; 15/256.53; 118/652

[58] Field of Search ..... 355/15, 3 FU, 14 R; 15/256.51, 256.53, 1.5; 118/652

[56] References Cited

U.S. PATENT DOCUMENTS 3,380,355 4/1968 Eichorn ..... 355/15
3,526,457 9/1970 Dimond et al. ..... 15/1.5 R
3,706,491 12/1972 Furman et al. ..... 355/3 FU
3,712,734 1/1973 Jovanovic ..... 355/15

FOREIGN PATENT DOCUMENTS 0052068 3/1982 Japan ..... 355/15

*Primary Examiner*—R. L. Moses
*Attorney, Agent, or Firm*—Fitzpatrick, Cella, Harper & Scinto

[57] ABSTRACT

This invention provides an image forming apparatus such as electrophotographic copier, microfilm equipment, recording equipment, facsimile or printer. According to this invention, a movable cleaning member is maintained in contact with a member to clean its surface, and the movement of the cleaning member is variably controlled according to the state of image formation.

23 Claims, 18 Drawing Figures

IMAGE FORMING APPARATUS HAVING A CLEANING MEMBER

BACKGROUND OF THE INVENTION

1. Field of the Invention

The present invention relates to an image forming apparatus comprising means for cleaning a surface of a member with a movable cleaning member maintained in contact with said surface, and more particularly to such apparatus in which the movement of said cleaning member is variably controlled in response to the status of image formation.

2. Description of the Prior Art

In the following explanation an electrophotographic copier will be taken as an example of the image forming apparatus.

In such electrophotographic copier there is already known the use of a cleaning member such as a cleaning roller for eliminating deposited substances such as toner particles remaining on a member, and particularly widely used is a web cleaning device utilizing a cleaning web composed for example of non-woven cloth. FIG. 1 is a side view of such a conventional web cleaning device applied in the cleaning of a fixing device.

In FIG. 1 there is provided a pressure roller 3 of an elastic member rotatably supported to maintain a cleaning web 2 composed for example of non-woven cloth in contact with a rotatably supported fixing roller 1, and said cleaning web 2 is supplied from an unwind shaft 5 and is taken up on a driven winding shaft 4. An arrow 6 indicates the rotating direction of the fixing roller 1, and an arrow 7 indicates the advancing direction of the cleaning web 2. A copy sheet P bearing an unfixed image on the upper face thereof advances on a guide member 8 and is introduced between the fixing roller 1 provided therein with a heat source and a pressure roller 9 rotatably supported and maintained in contact with said fixing roller 1, whereby the unfixed image is fixed to the copy sheet by the heat and pressure. Thereafter the copy sheet P is ejected to the outside through a pair of ejecting rollers 10 rotated in mutually opposite directions. In the course of the above-described procedure, a part of the toner 11 constituting the image on the copy sheet P becomes adhered to the fixing roller 1, and such adhesion is called the offset phenomenon. The toner 11 thus deposited on the fixing roller 1 moves as indicated by the arrow 6 and is wiped away by the cleaning web 2 moving at a speed much lower than that of the fixing roller 1.

In such web cleaning device, the advancing amount of such web per unit time is selected in such a manner as to perform complete cleaning even in a continuous image forming operation. Consequently the web can be advanced by the necessary amount for each image forming operation. However, in ordinary copiers, the heat capacity of the heater of the fixing device has a limitation so that the temperature of the fixing roller becomes lower than the determined value in a continuous imaging operation, thus increasing the toner deposition on the fixing roller. Such phenomenon becomes more pronounced as the ambient temperature of the copier becomes lower.

(i) In this manner, the amount of toner deposited on the fixing roller is dependent on the temperature of the fixing roller, and, if the advancing amount of the cleaning web is fixed as in the conventional device independent from the temperature of the fixing roller, complete cleaning of the fixing roller may not be possible when the temperature thereof becomes significantly lower than the predetermined value in a continuous imaging operation. On the other hand, if the advancing amount of the cleaning web is made larger in order to avoid such drawback, the web is wasted as long as the fixing roller is maintained at the predetermined temperature, thus requiring frequent replenishments.

(ii) Also in case the image density is low, the cleaning web is wastedly advanced although there is sufficient cleaning ability. On the other hand, in case the image density is high, complete cleaning may not be possible because the cleaning ability of the web is limited.

(iii) In the conventional web cleaning device, the advancement of the cleaning web is synchronized with the rotation of the main motor and/or the fixing roller. As already known, the main motor has to perform pre- and post-rotation steps in order to attain uniform surface potential on the photosensitive drum, and the fixing roller has to perform a pre-rotation step until it reaches a predetermined temperature for obtaining uniform temperature distribution so that the main motor and/or fixing roller must be operated beyond the necessary time period for copying operation.

Consequently, during these steps not included in the actual copying operation, the web has to be wastefully advanced, thus requiring frequent replenishment.

(iv) In the web cleaning device for a copier, the advancing amount of the web per unit time can generally be fixed at a predetermined value. However, in a copier in which the peripheral speed of the photosensitive drum changes for equal-size copying and reduced-size copying, for example from a high speed of 270 mm/sec at the equal size copying to a low speed of 180 mm/sec at the reduction copying, such web cleaning device is associated with the following drawbacks. If the advancing amount of the cleaning web per unit time is so selected to completely remove the toner deposited on the fixing roller at the low peripheral speed of the photosensitive drum, the web cleaning device may not be able to achieve complete cleaning at the copying operation with the high peripheral speed of the photosensitive drum. On the other hand, if said advancing amount is so selected to completely remove the deposited toner at the high peripheral speed of the photosensitive drum, the cleaning device will result in a waste of the cleaning web in the copying operation with the low peripheral speed of the photosensitive drum, requiring frequent replacement of the cleaning web.

SUMMARY OF THE INVENTION

An object of the present invention is to provide an image forming apparatus capable of completely removing the substance deposited on a member requiring cleaning.

Another object of the present invention is to provide an image forming apparatus capable of reducing wasteful feeding of a cleaning member.

Still another object of the present invention is to provide an image forming apparatus capable of extending the interval of replacement of the cleaning member.

The foregoing objects can be achieved according to the present invention by an image forming apparatus for forming an image on a sheet corresponding to input information, comprising a cleaning member maintained in contact with a member to be cleaned for removing deposits from the surface of said member to be cleaned, driving means for driving said cleaning member, detecting means for detecting the image forming conditions, and control means for variably controlling the displacement of said cleaning member in response to the output signal from said detecting means thereby controlling the displacement of said cleaning member.

DESCRIPTION OF THE PREFERRED EMBODIMENTS

Now the present invention will be described in detail referring to embodiments thereof. At first, reference is made to FIG. 2 showing an electrophotographic copier embodying the present invention.

Figure 2:
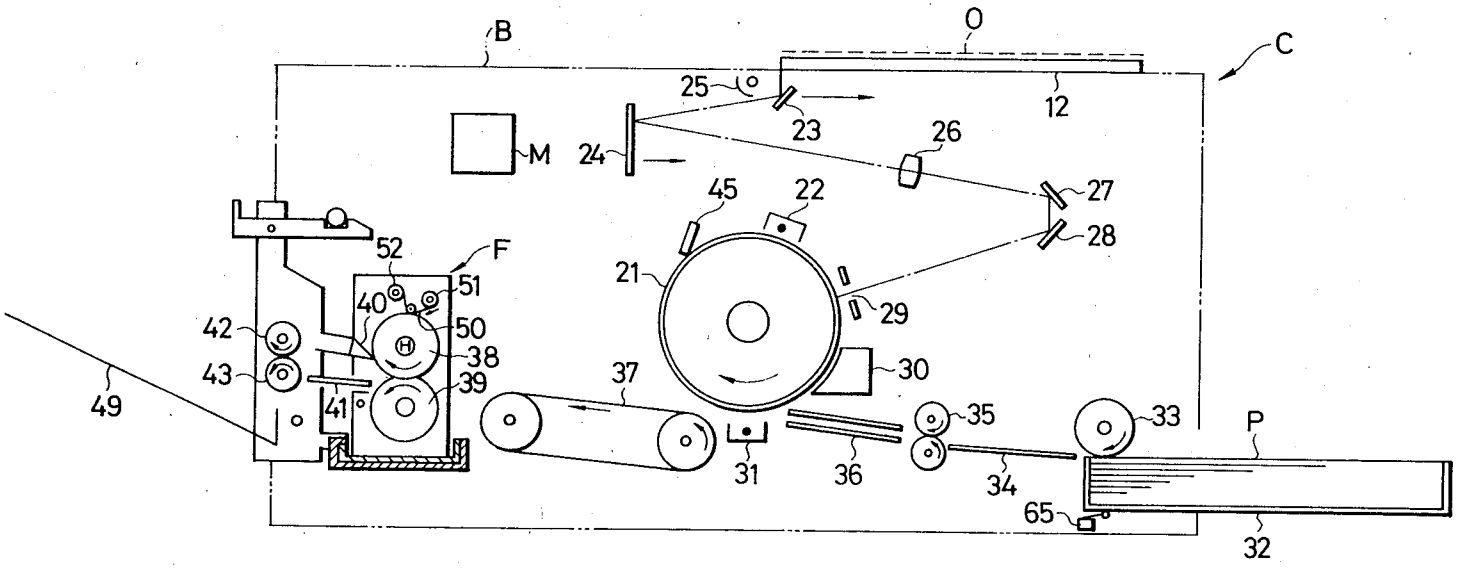
FIG. 2 is a side view of an electrophotographic copier embodying the present invention.

In FIG. 2, a photosensitive drum 21, having an electrophotographic photosensitive member along the periphery thereof and rotated in the direction of arrow is at first uniformly charged by a corona discharger 22 and is exposed through a slit 29 to an optical image of an original O to form an electrostatic latent image corresponding to said original O on the drum 21.

The original O is placed on a carriage glass plate 12 and is scanned by scanning mirrors 23, 24 moved in the indicated directions at a speed ratio of 1:½, while being illuminated by a light source 25 integrally moving with the mirror 23. The scanned original O is focused by a lens 26, the focused light flux is reflected by fixed mirrors 27, 28 and enters the drum 21 through the aforementioned slit 29.

The aforementioned latent image is developed in a developing unit 30 into a toner image, which is transferred onto a copy sheet P under the effect of a transfer discharger 31. Said copy sheet P is advanced, one by one, by a roller 33 from a cassette 32, and is guided through a guide 34 to a timing roller 35, which advances said copy sheet in synchronization with the original scanning along a guide 36 to the image transfer position for effecting the image transfer as described above. After said image transfer, the copy sheet P is separated from the drum 21 and is advanced by a belt 37 to a fixing device F, which comprises a fixing roller 38 provided therein with a heat source H and a pressure roller 39 maintained in pressure contact with said fixing roller 38, said rollers being rotated in the directions of arrows to transport the copy sheet. At said transport the toner image bearing surface of the copy sheet P comes into contact with the roller 38, whereby the toner image is fused by the heat of the roller 38 and is fixed to the copy sheet P. The copy sheet P having passed the nip between the rollers 38, 39 is guided, by a separating claw 40 maintained in contact at the front end thereof with the roller 38 and by a guide 41 positioned facing said claw 40 to constitute a path for the copy sheet P, to ejecting rollers 42, 43. The rollers 42, 43 are respectively rotated in the directions of the arrows to transport the copy sheet P supplied from the rollers 38, 39, thus ejecting or discharging said sheet onto a tray 49.

The toner remaining on the photosensitive drum 21 after the image transfer is eliminated by a cleaning member 45, whereby the photosensitive drum 21 is repeatedly used in the above-described image forming process. The photosensitive drum 21 and the fixing roller 38 etc. are driven by a main motor M.

In the present embodiment, a cleaning web 50 is maintained in contact with the peripheral surface of the fixing roller 38 for eliminating the substances, such as toner, adhered on said peripheral surface.

Figure 1:
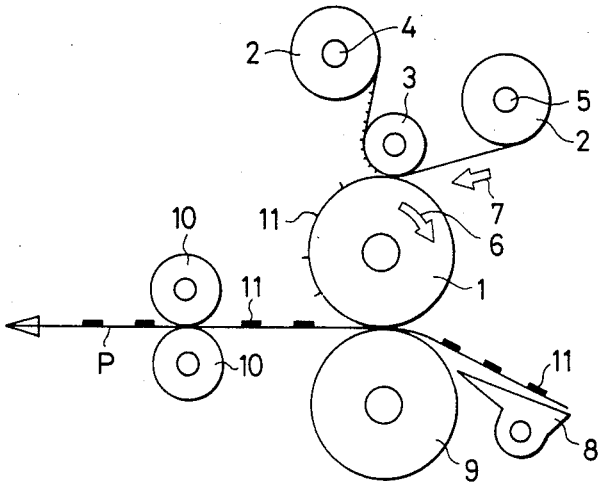
FIG. 1 PRIOR ART
FIG. 1 is a schematic side view showing a conventional cleaning device applied to a fixing device.
Figure 3:
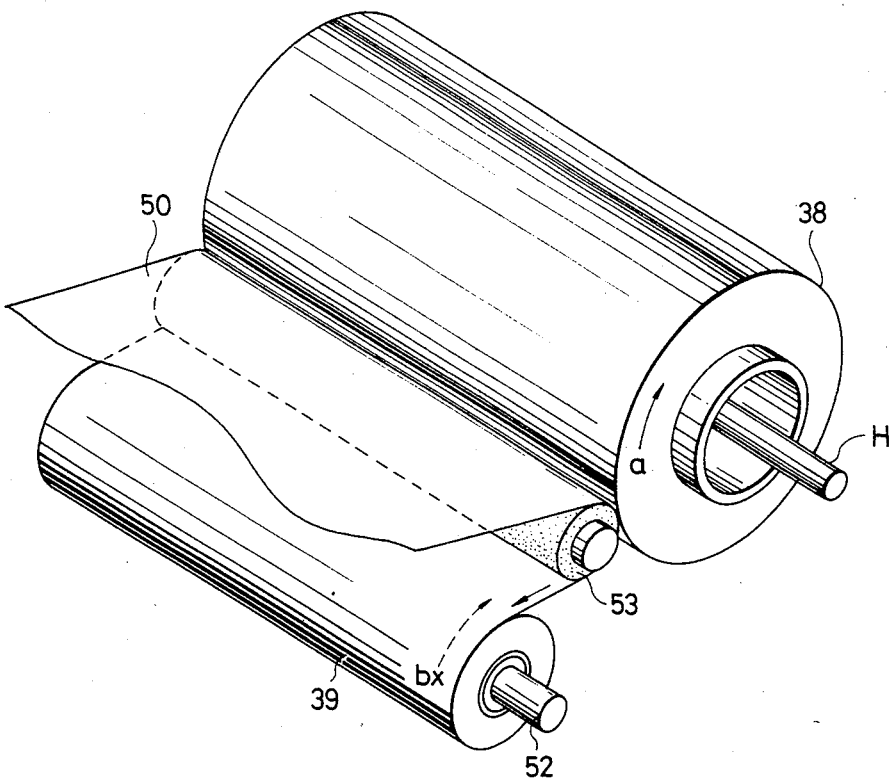
FIG. 3 is a schematic perspective view of a cleaning web representing an embodiment of the present invention.

Now reference is made to FIG. 3 showing the cleaning web provided in the fixing device F in a schematic perspective view.

The fixing roller 38 coming into contact with the toner image bearing surface of the copy sheet P is internally provided with a heater H for supplying the thermal energy required for fusing the toner powder and fixing the same to the copy sheet P. Said fixing roller 38 is composed of a metal roller provided on the surface thereof with a thin layer of chromium plating or a thin layer of tetrafluoroethylene resin. The pressure roller 39 is composed of a metal core covered with a relatively thick layer of an elastic member such as silicone rubber, and is rendered movable, by a not-shown pressurizing mechanism, between a fixing position in which it is in pressure contact with the heating roller 38 and a non-fixing position in which it is separated from the heating roller 38. The fixing roller 38 is driven in the direction of arrow by the main motor M, and the pressure roller 39 is driven by the roller 38 through friction, whereby the copy sheet P inserted between said rollers is subjected to image fixation. The web 50 is composed of a heat-resistant sheet material such as non-woven cloth, impregnated with a suitable amount of a releasing agent, is wound as a roll on an unwinding shaft 51 and is maintained in contact with the fixing roller 38 by a pressure roller 53 in the course of transport to the winding shaft 52. The pressure roller 53 is composed of a heat-resistant spongy or other material capable of absorbing the releasing agent, and has a function of maintaining the amount of the releasing agent to be coated on the fixing roller 38 at a constant level, by absorbing a part of the releasing agent present in the web 50 and again releasing the same at the nip area of the rollers.

Now there will be explained an embodiment of the present invention, in which the advancement of the cleaning web is variably controlled in response to the temperature of the fixing roller and the ambient temperature thereof.

Figure 4:
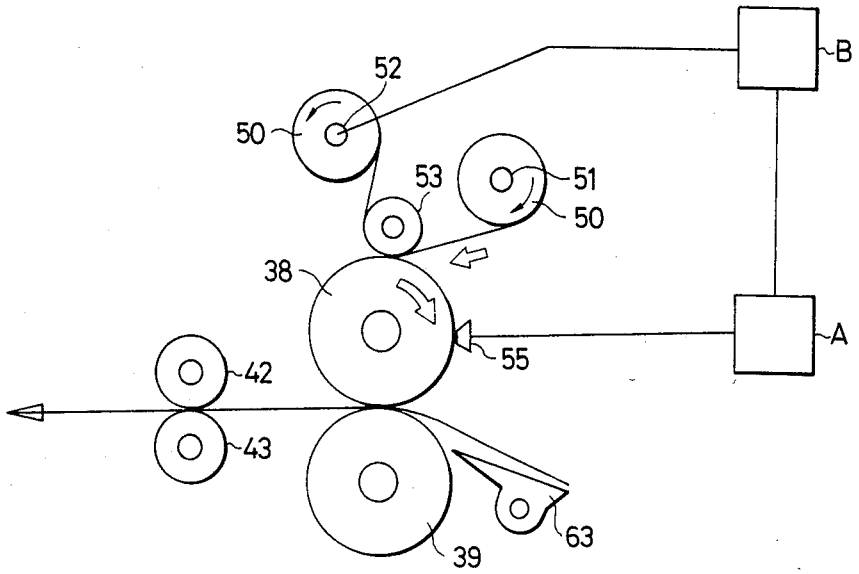
FIG. 4 is a side view of a web cleaning device.
Figure 5:
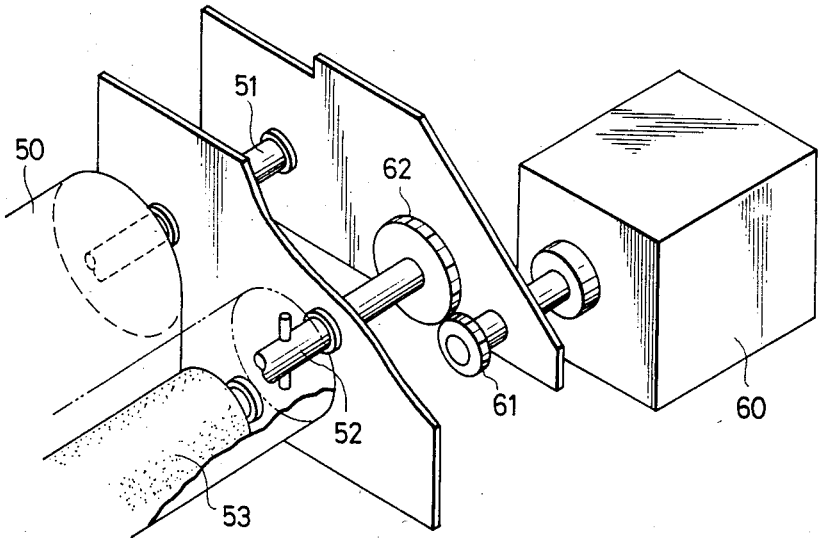
FIG. 5 is a perspective view of a web driving device.

FIG. 4 is a schematic side elevational view of the web cleaning device, provided with a sensor 55 for detecting the peripheral temperature of the fixing roller 38. The output signal from the sensor 55 is supplied to a control circuit A to drive a driving device B for rotating the winding shaft 52. FIG. 5 shows the web driving device B in a perspective view, wherein shown are the cleaning web 50 composed for example of non-woven cloth, pressure roller 53, winding shaft 52 for the web 50 and unwinding shaft 51 therefor. The motor 60 is provided, on a shaft thereof, with a gear 61 meshing with a gear 62 fixed on the web winding shaft 52.

In the present embodiment, the motor 60, for example, of a synchronous motor for driving the winding shaft 52 of the web 50 through the gears 61, 62 is controlled in its driving time period by the copying operation of the copier and the temperature of the fixing roller 38.

Figure 6:
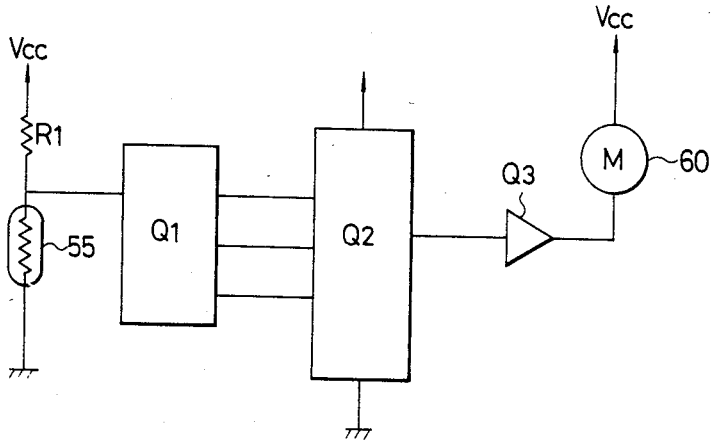
FIG. 6 is a diagram of the control circuit.
Figure 7:
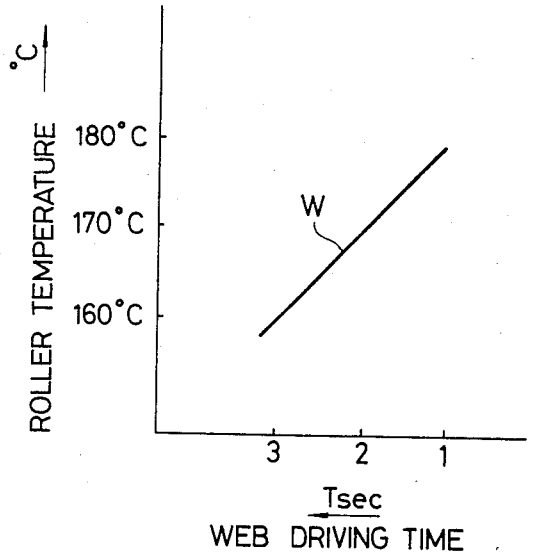
FIG. 7 is a chart showing the web driving time.

The activated period of said motor 60 is controlled by a driver to be explained later, through the control circuit A shown in FIG. 6. The temperature sensor 55 for the roller 38 is of a resistance wire thermometer, which receives a constant voltage through a resistor R1, and the obtained output signal is supplied, after analog-to-digital conversion in an A/D converter Q1, to a microcomputer Q2, of which an output signal activates the motor 60 through a driver Q3 after being amplified thereby. Said microcomputer Q2 controls the advancing time of the web 50 according to the temperature of the surface of the fixing roller 38 as shown in FIG. 7, which illustrates the web driving time along the abscissa as a function of the surface temperature of the fixing roller along the ordinate. As an example, according to web driving time line W the motor 60 is activated for 1 second or 2 seconds respectively when the surface temperature of the fixing roller 38 is 180° C. or 170° C.

In the foregoing embodiment there is provided means for detecting the temperature of the member to be cleaned and control means for controlling the advancing time of the cleaning member in response to said temperature. This embodiment is therefore capable of driving the cleaning member in an amount required for achieving complete removal of the deposit on the member to be cleaned regardless of the change in the temperature thereof, thereby improving the efficiency of use of the cleaning member and ensuring a stable cleaning effect.

In the foregoing embodiment a microcomputer is employed for the control, but there will now be shown another embodiment for controlling the driving time of the web 50 without the use of such microcomputer.

Figure 8:
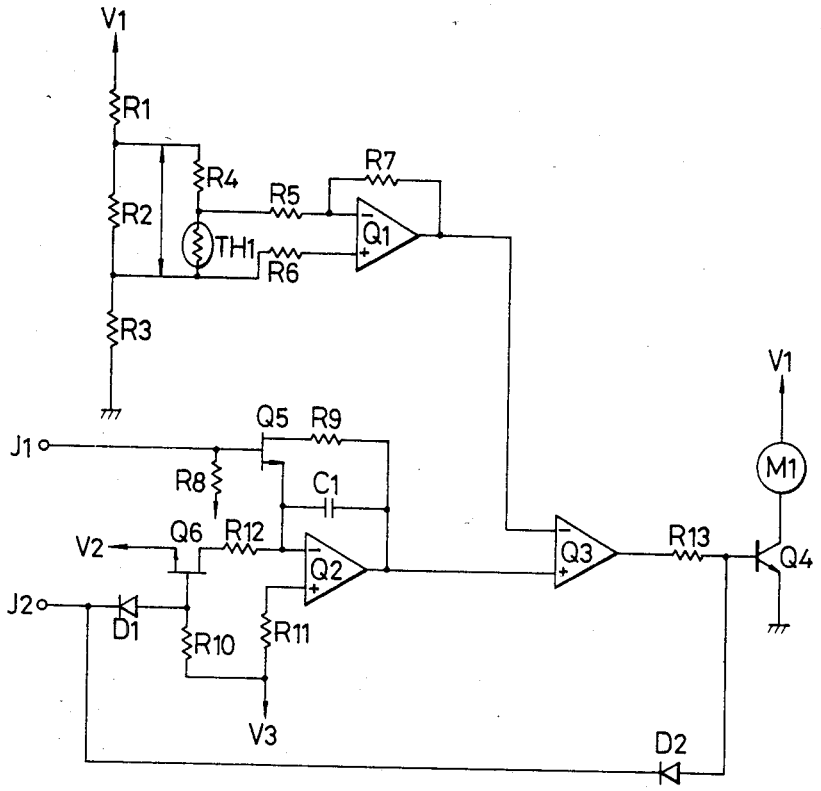
FIG. 8 is a diagram of another control circuit.
Figure 9:
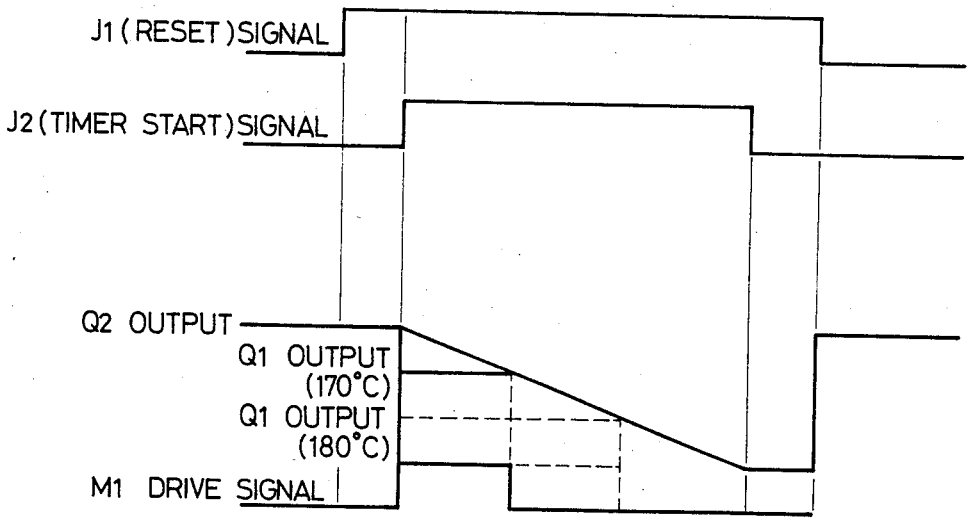
FIG. 9 is a chart showing the function thereof.

FIG. 8 shows a control circuit of said embodiment, and FIG. 9 shows a chart explaining the function thereof.

In FIG. 8 there are shown fixed resistors R1–R12, a thermistor TH1, a condenser C1, differential amplifiers Q1–Q3, a transistor Q4, field effect transistors Q5, Q6, and diodes D1, D2. The resistors R1, R2, R3 shown in FIG. 8 constitute a voltage supply to the thermistor, and a voltage between the thermistor TH1 and the resistor R4 representing the temperature of the roller of the fixing device F is amplified by the amplifier Q1 to generate a signal determining the time of activation of the motor 60 for driving the web 50. The reference signal determining the driving time of said web 50 is given by integration in a Miller's integrating circuit constituted by the resistor R12, condenser C1 and differential amplifier Q2, and the driving time of said motor 60 is determined by the comparison of the output signal of said differential amplifier Q1 and the output signal of the integrator Q2 in the comparator Q3. Said integrater is reset by discharging the condenser C1 through the resistor R9 and FET Q5 in response to a reset signal J1, and is triggered by reducing the drain-source resistance of the FET Q6 in response to a timer start signal J2.

In this embodiment it is also rendered possible to control the driving time of the cleaning member in response to the temperature of the member to be cleaned.

In the following, there will be explained another embodiment in which the advancement of the cleaning member is variably controlled in response to the size of the recording sheet.

Figure 10:
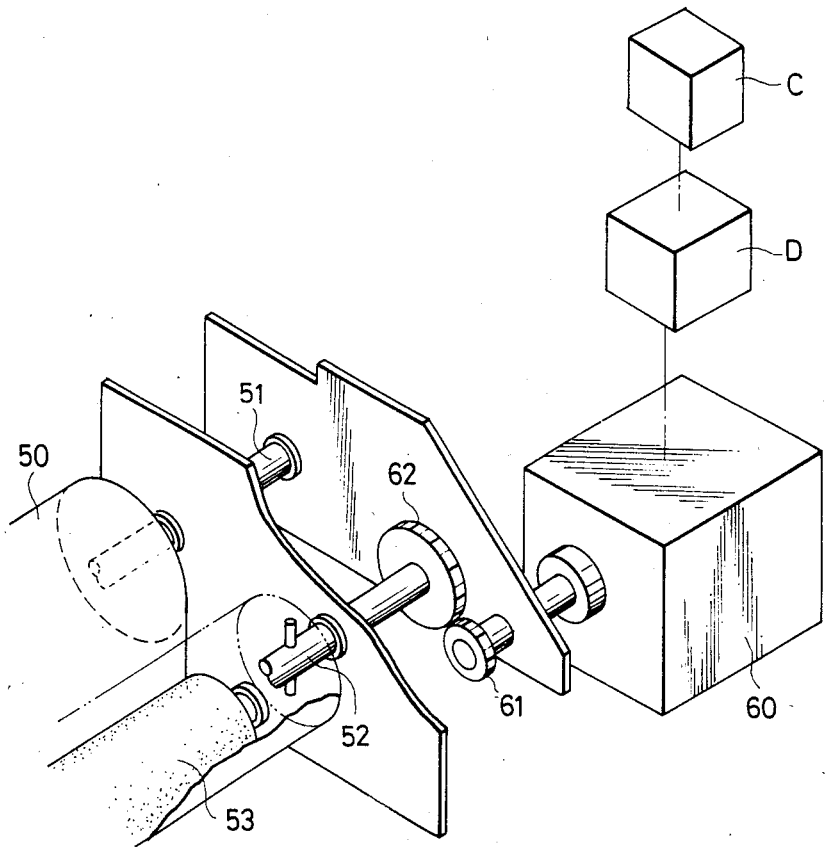
FIG. 10 is a perspective view of a web driving device.

FIG. 10 is a perspective view of the web driving device of this embodiment, wherein shown are the cleaning web 50 composed for example of non-woven cloth, pressure roller 53, web winding shaft 52, and unwinding shaft 51. The motor 60 is provided on the shaft thereof with the gear 61 which meshes with the gear 62 fixed on the winding shaft 52 for the web 50. In this manner said winding shaft 52 for the web 50 is driven independent from the rotation of the photosensitive drum 21 or the fixing roller 38. There are also provided sheet size detecting means C and a control device D for controlling the amount of advancement of the cleaning member in response to the output signal from said detecting means C.

Figure 11:
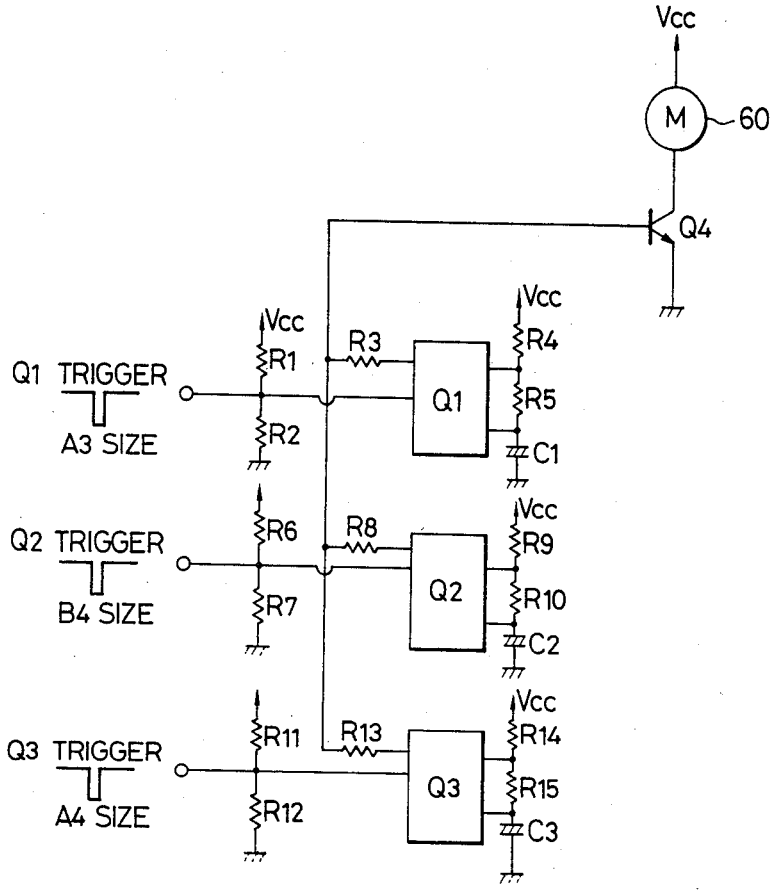
FIG. 11 is a diagram of another control circuit.

FIG. 11 shows an example of the motor control circuit in the control device D shown in FIG. 10. In FIG. 11 there are shown timer integrated circuits Q1, Q2 and Q3, resistors R1 through R15, condensers C1 to Ce, and a driver transistor Q4. As an example, in case of A3-size copying, a trigger signal is supplied to the timer integrated circuit Q1 to activate the motor 60 through the resistor R3 and transistor Q4 during a period predetermined by Q1, R4, R5 and C1, thereby correspondingly advancing the web 50. The timer integrated circuits Q2 and Q3 function is similar manner for different sizes, for example sizes A4 and B4, thereby determining the driving time of the motor 60 as shown in FIG. 12.

Figure 12:
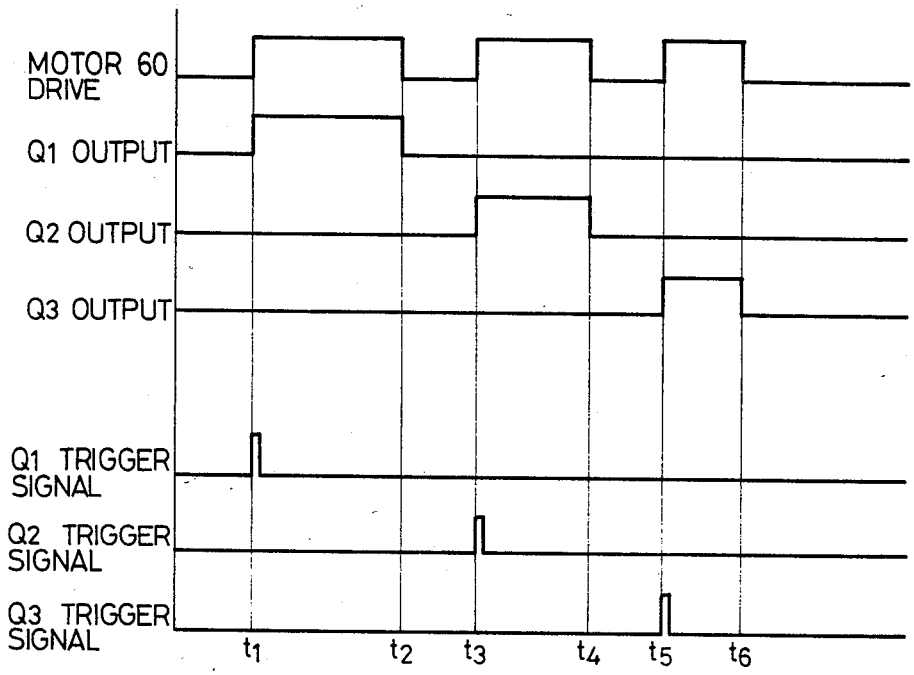
FIG. 12 is a timing chart.

Referring to FIG. 12, when the copying mode is selected at time t1 to copy an original of A3 size, a trigger signal for Q1 is generated simultaneously with the start of copying operation to activate the motor 60 for a period (t2−t1) by the above-described timer circuit Q1, R4, R5 and C1. Then, when the copying mode is selected at time t3 to copy an original of B4 size, a trigger signal for Q2 is generated simultaneously with the start of copying operation to activate the motor 60 for a period (t4−t3) by the timer circuit Q2, R9, R10 and C2. Similarly when the copying mode is selected at time t5 to copy an original of A4 size, a trigger signal for Q3 is generated to activate the motor 60 for a period (t6–t5). In the present embodiment the activating time is made longer as the longitudinal length of the copy sheet becomes larger.

The above-mentioned trigger signals for Q1, Q2, Q3 can be generated by a microswitch 65 (FIG. 2) to be actuated by mounting of a sheet cassette 32 for A3, B4 or A4 size on the copier C in combination with the copy start signal, or by a switch provided in the sheet feeding path in the copier C.

In the foregoing embodiment the control circuit determines the driving time of the cleaning web motor 60 according to the contact time of the copy sheet of various sizes with the photosensitive drum or with the fixing roller, in response to a signal representing the size of the copy sheet. In this manner this embodiment regulates the advancing amount of the cleaning member according to the size of the copy sheet, thereby improving the efficiency of use of the cleaning member and ensuring stable cleaning effect. The size of the copy sheet can also be detected by other known means than the microswitch, such as a photointerrupter.

Now there will be explained another embodiment in which the advancement of the cleaning web is variably controlled in response to the image density of the original.

Figure 13:
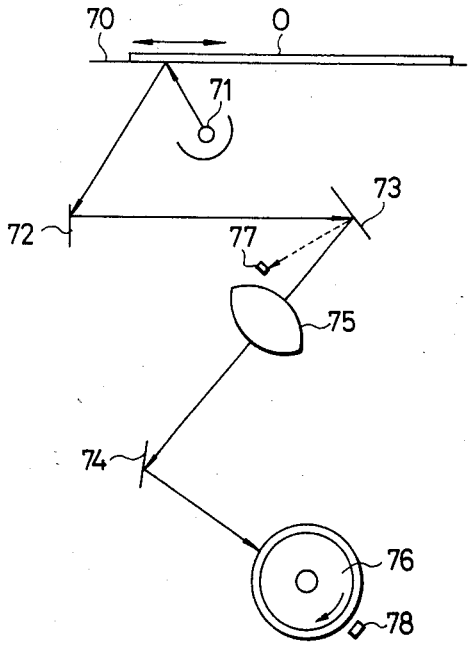
FIG. 13 is a schematic view of image density detecting means.

In this embodiment the driving time of the motor 60 is controlled by the driver in response to the image density, which is detected by detecting means shown in FIG. 13.

In FIG. 13, an original O placed on a carriage 70 is illuminated by an exposure lamp 71, and the light is projected through mirrors 72, 73, 74 and a lens 75 onto a photosensitive drum 76 for image formation. In the present embodiment a photoreceptor 77 functioning as the density detector is positioned in a part of the optical path, and detects the reflective density of the original O during the course of the scanning of said original O by the displacement of said carriage 70.

The density detector may also be constituted by a potential sensor 78 measuring the surface potential of the photosensitive drum. Also the present embodiment is not necessarily limited to the movable original carriage but also is applicable to the fixed original carriage as shown in FIG. 2.

Figure 14:
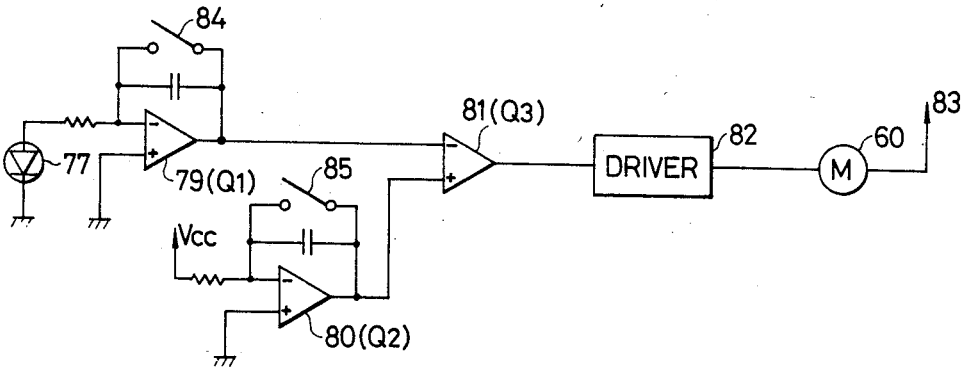
FIG. 14 is a diagram of a control circuit therefor.

FIG. 14 shows the detailed circuit structure of the control circuit for determining the web driving time in response to the detected density. The density sensor need not necessarily be positioned as explained before but may be positioned in the original scanning optical system or be positioned to receive light guided from the optical path for example by a half mirror.

In FIG. 14 there are shown an integrator 79 (Q1) for integrating the reflective density from the sensor 77; a reference signal generator 80 (Q2) for determining the motor driving time; a comparator 81 (Q3) for comparing the output signal of the integrater 79 with that of the reference signal generator 80 to drive the motor 60 through a driver 82 for rotating the web winding shaft 52 for a determined period; and resetting circuits 84, 85 for the integrating circuit etc.

Figure 15:
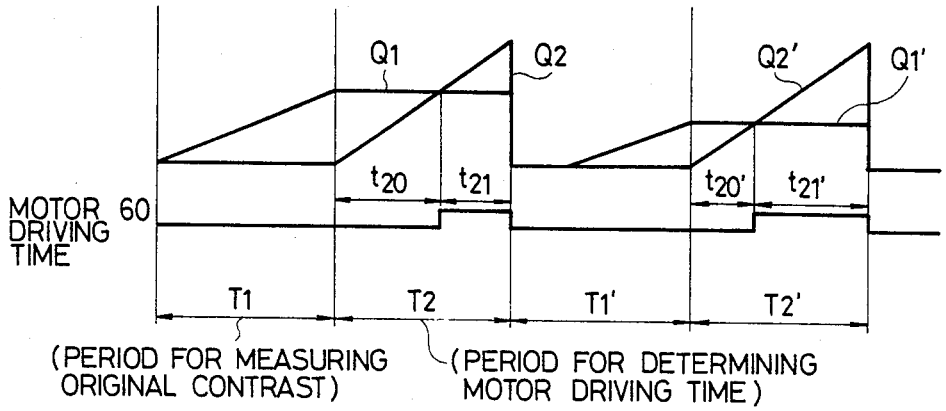
FIG. 15 is a timing chart thereof.

FIG. 15 is a timing chart showing the function of the above-described circuit as a function of time along the abscissa.

At first, at a time T1, the density of the original is measured and is held in the integrator 79. Then, in a time T2, the reference signal generator 80 (Q2) generates a determined waveform. Period t20 until the signal Q2 reaches the held signal Q1 and period t21 until the signal Q2 terminates after the signal Q2 exceeds said held signal Q1 are determined by said held value Q1. As the illustrated circuit is designed to measure the reflective contrast of the original, said held value Q1 becomes higher or lower as the original contains more white area or black area. Therefore the web driving time is made shorter or longer respectively for an original with a larger white area requiring less toner consumption or for an original with a larger black area requiring more toner consumption, if the motor driving time is controlled according to the period t21. Naturally the signal sampling time and the waveform generated by the reference signal generator etc. are determined in consideration of the cleaning performance of the cleaning web. In this manner the advancing amount of the cleaning web is constantly maintained at an optimum level by repeating the measurement of the original density or contrast and the comparing step.

As explained in the foregoing, this embodiment ensures efficient cleaning performance with a minimum necessary web consumption.

Now there will be explained another embodiment in which the advancing amount of the cleaning member is variably controlled in response to the imaging process speed.

Figure 16:
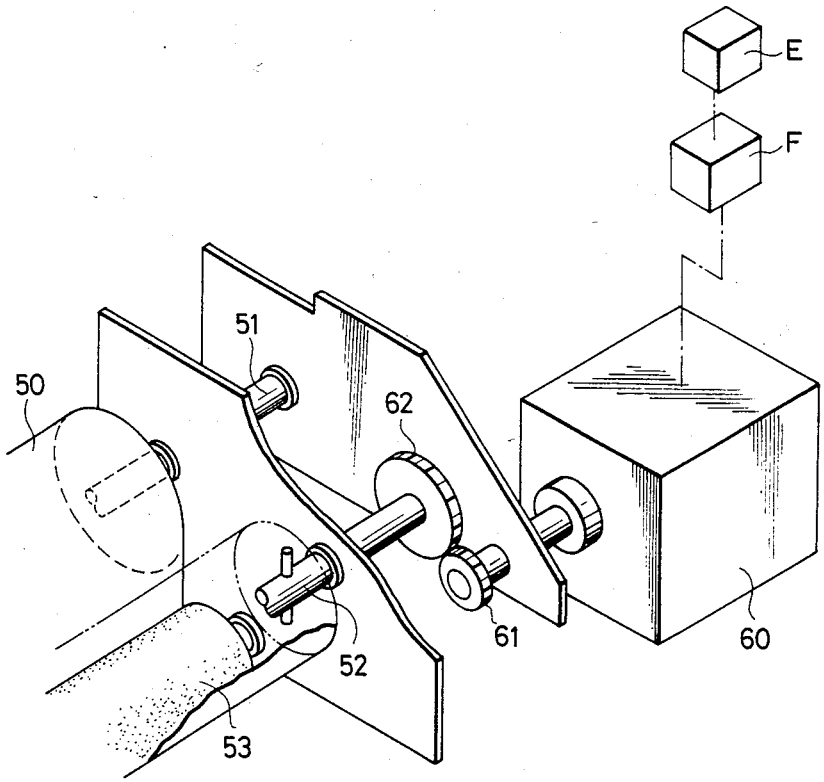
FIG. 16 is a perspective view of a web driving device.

FIG. 16 is a perspective view of the web driving device of the present embodiment in a perspective view, wherein there are shown cleaning web 50 composed for example of non-woven cloth, pressure roller 53, web winding shaft 52, and unwinding shaft 51. The motor 60 is provided on the shaft thereof with the gear 61, which meshes with the gear 62 fixed on the web winding shaft 52. In this manner the web winding shaft 52 is driven independently from the rotation of the photosensitive drum of fixing roller. There are further provided means E for detecting the speed of the image forming process, and means F for controlling the drive of the motor 60 in response to the output signal from said detecting means E.

The detecting means E detects for example the speed V0 or V which is variable according to the image magnification, through the displacement of transmission gears 61 and 62 or through the peripheral speed of the photosensitive drum 21 itself. Also said detection can be made by sensing the image magnification or the size of the copy sheet used. Consequently the detecting means E can be composed of various known means such as a photointerrupter or microswitch. As an example the rotating speed of the photosensitive drum can be detected by directing or intercepting the light from a light-emitting diode to a phototransistor by means of a light shield plate rotating in synchronization with the photosensitive drum.

The control means F is provided with a suitable control program to activate the motor, for example, for a duration t0 corresponding to a drum speed V0 or to regulate the speed thereof to V0', and to activate the motor for a duration t corresponding to a drum speed V or to regulate the speed thereof to V'. The activated period of the motor 60 is controlled by a driver in a control circuit shown in FIG. 17.

Figure 17:
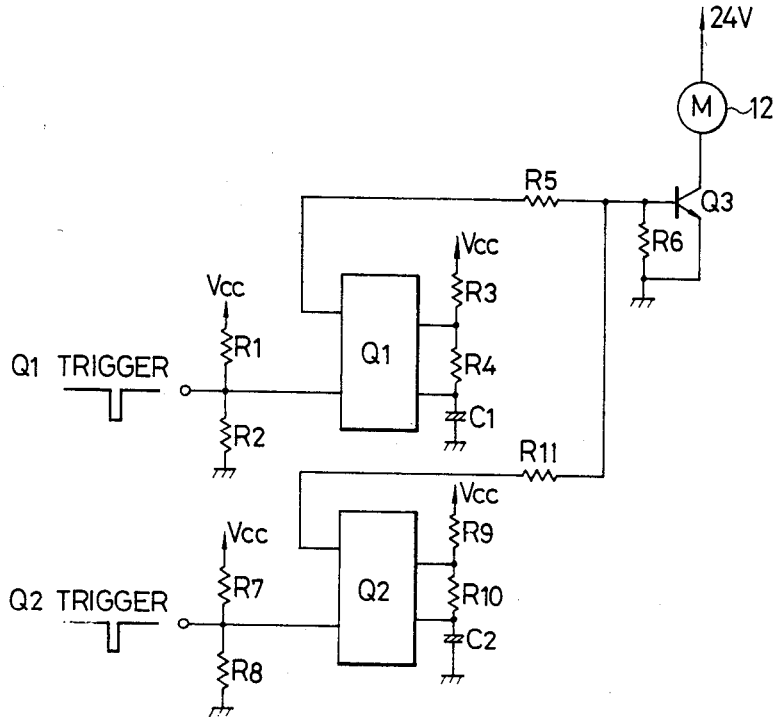
FIG. 17 is a diagram of a control circuit therefor.

In FIG. 17 there are shown timer integrated circuits Q1, Q2; resistors R1 to R11; condensers C1 and C2; and a driver transistor Q3. In the case of a high peripheral drum speed, a trigger signal Q1 is supplied to the timer integrated circuit Q1 to activate the motor 60 through the transistor driver Q3 and the resistor R5 for a duration determined by Q1, R3, R4 and C1. Also at a low peripheral drum speed, a trigger signal Q2 is supplied to the timer integrated circuit Q2 to activate the motor 60 through the driver Q3 and the resistor R11 for a duration determined by Q2, R9, R10 and C2.

Figure 18:
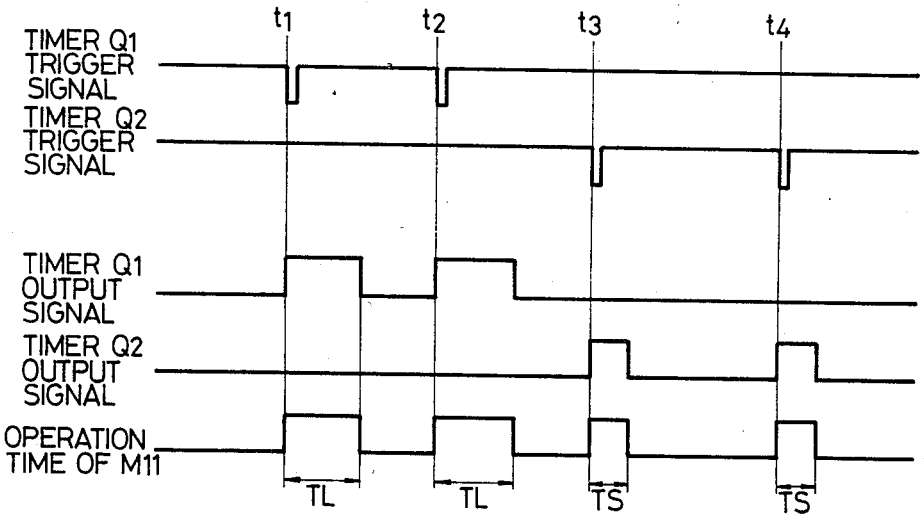
FIG. 18 is a timing chart thereof.

FIG. 18 is a timing chart showing the function of the circuit shown in FIG. 17 as a function of time along the abscissa. When the copying operation is set to initiate with the high-speed rotation of the photosensitive drum, the trigger signal Q1 is supplied at a time t1 to activate the motor 60 for a duration TL, and to advance the web 50 for the same duration, through the transistor driver Q3 and the resistor R5 by Q1, R3, R4 and C1. Then, in response to the start of a succeeding copying operation, the trigger signal Q1 is supplied at a time t2, thereby advancing the web 50 for a duration TL in the same manner. Then, in case the copying operation is initiated with the low-speed rotation of the photosensitive drum, the trigger signal Q2 is supplied at a time t3 to activate the motor 60 for a duration TS, thereby advancing the web 50 in a corresponding manner, through the resistor R11 and the driver Q3 by Q2, R9, R10 and C2. Also in a succeeding copying operation, the trigger signal Q2 is supplied at a time t4 to advance the web 50 for the duration TS.

In the foregoing embodiment there is provided means for detecting the process speed of the image forming apparatus, and the advancing amount of the cleaning member is rendered variable in response to the output signal from said detecting means, namely according to said process speed. In this manner the present embodiment regulates the advancing amount of the cleaning member according to the speed of the image forming process, thereby improving the efficiency of use of the cleaning member and ensuring a stable cleaning effect.

In the foregoing embodiments the temperature of the member to be cleaned or the ambient temperature thereof, the original density or contrast, the size of the recording material and the speed of the image forming process have been shown as examples of the image forming conditions. However the present invention is not limited to such examples but is applicable to other image forming conditions such as the kinds of the developer.

It will also be understood that the foregoing embodiments may be executed singly or in suitable combination. More specifically, the advancement of the cleaning member may be controlled according to either one of the image forming conditions or according to a combination of plural conditions.

The member to be cleaned is not limited to the fixing roller but can also be an image bearing member such as a photosensitive drum or an insulating drum.

Also the cleaning member is not limited to the cleaning web explained before but can be a cleaning roller or the like.

As explained in the foregoing, the present invention provides an image forming apparatus with an improved cleaning efficiency, by the variable control of the displacement of the cleaning member in response to the image forming conditions.

What is claimed is:

1. In an image forming apparatus for image formation on a recording sheet corresponding to input information, the combination wherein the image may be formed on various sizes of recording sheets comprising:

a cleaning member for eliminating substances deposited on a surface of a member to be cleaned:

means for driving said cleaning member while in contact with the member to be cleaned; and means for variably controlling the displacement of said cleaning member in response to the size of the recording sheet in use.

2. An image forming apparatus according to claim 1, wherein said controlling means has means for controlling an activating time of advancement of said cleaning member in response to the sheet size.

3. An image forming apparatus according to claim 2, wherein the activating time controlling means makes the activating time longer as the longitudinal length of the sheet becomes longer.

4. An image forming apparatus according to claim 2, wherein said variably controlling means has a control circuit for changing the activating time in response to the sheet size.

5. An image forming apparatus according to claim 1, wherein said cleaning member is a cleaning web which is impregnated with a releasing agent.

6. In an image forming apparatus for image formation on a sheet corresponding to input information, the combination comprising:

a cleaning member for eliminating substances deposited on a surface of a member to be cleaned;

means for driving said cleaning member while in contact with the member to be cleaned; and means for variably controlling the displacement of said cleaning member in response to the temperature of the member to cleaned or the ambient temperature thereof, said temperature varying according to current conditions.

7. An image forming apparatus according to claim 6, wherein said controlling means has means for controlling an activating time of advancement of said cleaning member in response to said temperature.

8. An image forming apparatus according to claim 7, wherein the activating time controlling means makes said activating time longer as said temperature decreases.

9. An image forming apparatus according to claim 7, wherein said variably controlling means has a control circuit for changing the activating time in response to said temperature.

10. An image forming apparatus according to claim 6, wherein said cleaning member is a cleaning web which is impregnated with a releasing agent.

11. In an image forming apparatus for image formation, with toner, on a sheet corresponding to input information, the combination wherein various images may be formed and the toner consumption for each of the images may vary comprising:

a cleaning member for eliminating substances deposited on a surface of a member to be cleaned;

means for driving said cleaning member while in contact with said member; and means for variably controlling the displacement of said cleaning member in response to an image forming condition indicative of the toner consumption for the image.

12. An image forming apparatus according to claim 11, wherein said image forming condition is the density of an original image.

13. An image forming apparatus according to claim 11, wherein said controlling means has a potential sensor for detecting said image forming condition.

14. An image forming apparatus according to claim 11, wherein said controlling means has a means for controlling an activating time of advancement of said cleaning member in response to said condition.

15. An image forming apparatus according to claim 14, wherein said activating time controlling means makes said activating time longer as more toner is consumed.

16. An image forming apparatus according to claim 14, wherein said variably controlling means has a control circuit for changing said activating time in response to said image forming condition.

17. An image forming apparatus according to claim 11, wherein said cleaning member is a cleaning web which is impregnated with a releasing agent.

18. In an image forming apparatus for image formation on a sheet corresponding to input information, the combination comprising:

a cleaning member for eliminating substances deposited on a surface of a rotating member to be cleaned;

means for driving said cleaning member while in contact with said rotating member; and means for variably controlling the displacement of said cleaning member in response to a speed of said rotating member which is adjustable to a first speed or a second speed lower than said first speed.

19. An image forming apparatus according to claim 18, wherein said speed is adjustable in accordance with image magnification.

20. An image forming apparatus according to claim 18, wherein said controlling means has means for controlling an activating time of advancement of said cleaning member in response to said speed.

21. An image forming apparatus according to claim 20, wherein said activating time controlling means makes said activating time longer as said speed is increased.

22. An image forming apparatus according to claim 18, wherein said variably controlling means has a control circuit for changing said activating time in response to said speed.

23. An image forming apparatus according to claim 18, wherein said cleaning member is a cleaning web which is impregnated with a releasing agent.

* * * * *

UNITED STATES PATENT AND TRADEMARK OFFICE

CERTIFICATE OF CORRECTION

PATENT NO. : 4,557,588

DATED : December 10, 1985

INVENTOR(S) : MASAHIRO TOMOSADA

It is certified that error appears in the above-identified patent and that said Letters Patent is hereby corrected as shown below:

Column 2, line 10, "wastedly" should read --wastefully--.

Column 5, line 68, "integrater" should read --integrator--.

Column 6, line 37, "function is" should read --function in--.

Column 7, line 40, "integrater" should read --integrator--.

Column 9, line 51, "to be cleaned:" should read --to be cleaned;--.

Signed and Sealed this

*Thirtieth* Day of *September 1986*

[SEAL]

*Attest:*

DONALD J. QUIGG

*Attesting Officer*

*Commissioner of Patents and Trademarks*